US008033147B2

(12) United States Patent
Lie-Nielsen et al.

(10) Patent No.: US 8,033,147 B2
(45) Date of Patent: Oct. 11, 2011

(54) ELECTRONIC DEADBOLT LOCK WITH A LEVERAGE HANDLE

(75) Inventors: John Lie-Nielsen, Bradenton, FL (US); Tibor Szenti, Sarasota, FL (US)

(73) Assignee: HandyTrac Systems, LLC, Alpharetta, GA (US)

( * ) Notice: Subject to any disclaimer, the term of this patent is extended or adjusted under 35 U.S.C. 154(b) by 0 days.

(21) Appl. No.: 12/708,204

(22) Filed: Feb. 18, 2010

(65) Prior Publication Data

US 2010/0139342 A1 Jun. 10, 2010

Related U.S. Application Data

(62) Division of application No. 11/368,947, filed on Mar. 6, 2006, now Pat. No. 7,698,917.

(51) Int. Cl.
*E05B 55/00* (2006.01)

(52) U.S. Cl. ..... 70/143; 70/189; 70/218; 70/278.1; 70/278.2; 70/278.7; 70/279.1; 70/472; 292/142; 292/144; 292/DIG. 27

(58) Field of Classification Search ..... 70/143, 70/277, 278.1, 278.7, 279.1, 278.2, 283, 70/283.1, 472, 218, 149, 188, 189, 190, 191; 292/142, 144, DIG. 27
See application file for complete search history.

(56) References Cited

U.S. PATENT DOCUMENTS 1,006,816 A * 10/1911 Wolfe ..... 70/143
1,199,645 A 9/1916 Wicks
2,343,249 A 3/1944 Spinello
2,370,690 A * 3/1945 Schlage ..... 70/143
2,855,235 A 10/1958 Dellen
3,353,858 A 11/1967 Neary et al.
3,451,704 A 6/1969 Cothron
3,586,361 A * 6/1971 Ohno ..... 292/169
3,666,306 A * 5/1972 Genakis ..... 292/169.17
3,685,036 A 8/1972 Torok
3,748,878 A * 7/1973 Balzano et al. ..... 70/218
3,790,196 A 2/1974 Sanders et al.
3,912,309 A 10/1975 Fischer et al.
3,933,380 A 1/1976 Wellekens
4,031,725 A 6/1977 Reid
4,124,238 A 11/1978 Bischoff, Jr.
4,372,590 A 2/1983 Pilat et al.
4,534,194 A * 8/1985 Aydin ..... 70/278.2
4,594,864 A 6/1986 Hart
4,623,175 A 11/1986 Carroll
4,679,416 A 7/1987 Kambic
4,683,741 A 8/1987 Fields
4,708,379 A 11/1987 Ching
4,752,090 A 6/1988 Lin
(Continued)

FOREIGN PATENT DOCUMENTS

EP 0 145 420 B1 8/1989

*Primary Examiner* — Lloyd Gall
(74) *Attorney, Agent, or Firm* — Woodcock Washburn LLP

(57) ABSTRACT

An electronically controlled lock with a single throw acting as a passage lock and also as a deadbolt lock is provided by the invention. The lock is equipped with an electronic activation device on its exterior housing and a door lever on its internal housing. A user unlocks the door from outside by touching an electronic key against the electronic activation device. After the door is unlocked, the throw acts as a passage lock. The door can be locked internally by moving the door lever from a horizontal position upwardly to a vertical position.

8 Claims, 10 Drawing Sheets

U.S. PATENT DOCUMENTS 4,843,850 A 7/1989 McGregor
4,845,471 A 7/1989 Chu
4,887,442 A 12/1989 Lavelle
4,890,870 A 1/1990 Miron
4,945,737 A * 8/1990 Hart ..... 70/143
4,957,315 A 9/1990 Lin
4,972,182 A 11/1990 Novik et al.
4,979,768 A 12/1990 Marotto et al.
5,198,643 A 3/1993 Miron et al.
5,201,200 A 4/1993 Hauber
5,368,345 A 11/1994 Watts
5,447,047 A * 9/1995 Lin ..... 70/218
5,477,041 A 12/1995 Miron et al.
5,516,160 A 5/1996 Kajuch
5,615,919 A 4/1997 Ivey
5,884,515 A * 3/1999 Milman ..... 70/472
5,986,564 A 11/1999 Fraser
6,107,934 A 8/2000 Andreou et al.
6,135,512 A 10/2000 Galvin
6,297,725 B1 10/2001 Tischendorf et al.
6,427,505 B2 8/2002 Imedio
6,474,122 B2 11/2002 Davis
6,564,600 B1 5/2003 Davis
6,581,426 B2 6/2003 Bates et al.
6,604,394 B2 8/2003 Davis
6,612,141 B2 9/2003 Bates et al.
6,615,625 B2 9/2003 Davis
6,651,468 B2 11/2003 Aramburu et al.
6,718,806 B2 4/2004 Davis
6,793,254 B1 9/2004 Galvin
6,842,105 B1 * 1/2005 Henderson et al. ..... 340/5.73
6,895,791 B2 5/2005 Alexander et al.
6,895,792 B2 5/2005 Davis
6,938,445 B2 9/2005 Huang
7,040,125 B2 5/2006 Ciezki et al.
7,144,052 B1 * 12/2006 Kent et al. ..... 292/288
7,698,917 B2 4/2010 Lie-Nielsen et al.
2001/0005998 A1 * 7/2001 Imedio Ocana ..... 70/277
2002/0008390 A1 1/2002 Markbreit
2002/0144526 A1 * 10/2002 Ming-Chih ..... 70/218
2003/0205070 A1 * 11/2003 Chaum ..... 70/278.3
2005/0103066 A1 5/2005 Botha et al.
2005/0144994 A1 7/2005 Lies et al.
2005/0235711 A1 10/2005 Martin et al.

* cited by examiner

ELECTRONIC DEADBOLT LOCK WITH A LEVERAGE HANDLE

CROSS-REFERENCE TO RELATED APPLICATIONS

This application is a divisional of U.S. application Ser. No. 11/368,947 filed Mar. 6, 2006, now U.S. Pat. No. 7,698,917 issued Apr. 20, 2010, which is herein incorporated by reference in its entirety.

TECHNICAL FIELD

The present invention generally relates to locks, and more specifically, relates to single bolt lock with both a passage and deadbolt state and an electronic control of locking.

BACKGROUND

Locks are well known and used by every household. Generally speaking, there are two types of locks commonly used as door locks, passage lock and deadbolt lock. The passage lock typically includes a bolt mounted on a door frame along with a door knob and other connecting mechanism. The bolt usually has a surface slanted in relation to a longitudinal direction to which the bolt moves. The bolt that can slide, along the longitudinal direction, in and out of a receiving hole on a door frame with turn of the door knob. The bolt can be fixed on its extended position when a button on the door knob is pressed, thus locking the door. The deadbolt lock, on the other hand, typically includes a bolt that has a longer body and a surface that is perpendicular in relation to the longitudinal direction. The bolt can slide in and out of a receiving hole on the door frame with movement of a key inserted into the deadbolt lock. When a user wants an added security to his house, he usually installs a deadbolt lock in addition to the passage lock.

Electronic door locks are also well known and commonly used in the hotel industry. An electronic door lock generally includes an electronic control mechanism and a locking mechanism. The locking mechanism generally includes a deadbolt lock and a passage lock, each separated from the other. The electronic control mechanism typically unlocks the deadbolt and engages the passage lock. From inside, the deadbolt lock is usually activated by a turn knob placed above the door handle, putting the lock in passage mode. These electronic door locks are widely used by hotels, but they are not easily retrofitted into older doors where there is only one opening on the door frame for the passage lock. For hotel operators and residential home owners who like to have security of a deadbolt lock, they have to go through the job of modifying both the door and the door frame before a deadbolt lock can be installed.

SUMMARY

Briefly described, the electronic lock of the present invention can be easily retrofitted into an existing lock and provides easy use through electronic control and the added security of a deadbolt engagement. In one embodiment, the invention is an electronic lock capable of acting as a passage lock and as a deadbolt lock. The electronic lock comprises an external housing, an electronic access device on the external housing, a control circuit enclosed by the external housing and coupled to the electronic access device, an electrically activated mechanism coupled to the control circuit, a latch having a throw and being capable of extending the throw into a passage position and a locking position, a tail piece having a first end and a second end, an internal housing, and an inside lever mounted on the internal housing and engaged to the first end of the tail piece. The tail piece is engaged to an outside door lever, and the latch being engaged and disengaged by the electrically activated mechanism. Moving the inside lever from a horizontal position upwardly to a vertical position further engages the latch to extend the throw into the locking position, and activating the electronic access device from the outside disengages the outside door lever when the throw is in the locking position. The throw in the passage position enables the electronic lock to act as a passage lock and the throw in the locking position enables the electronic lock to act as a deadbolt lock.

In another embodiment, the invention is a method for using a single deadbolt lock as a passage lock and as a deadbolt lock. The method includes the steps of receiving an activation request from an activation access device, validating the activation request, recording the activation request into a log, engaging an external lever to a latch, and retracting a throw in the latch to a passage lock position.

In yet another embodiment, the invention is a method for using a single bolt of an electronic lock as a deadbolt and as a passage lock. The electronic lock is mounted on a door and has an internal lever, an external lever, a latch, and a throw. The method comprises providing on a door an electronic locking mechanism that has an activation access device, an internal lever, external lever, and a single bolt that has a passage position and locking position, and electronically disengaging the bolt while in the locking position by activating the activation access device, or alternatively, engaging the bolt into a locking position by rotating the internal lever from a horizontal position to a vertical position.

Other advantages and features of the present invention will become apparent after review of the hereinafter set forth Brief Description of the Drawings, Detailed Description of the Invention, and the Claims.

DETAILED DESCRIPTION OF ILLUSTRATIVE EMBODIMENTS

In this description, the terms "door lever," "lever," and "door handle" are used interchangeably; the terms "bolt" and "throw" are used interchangeably. The term "application" as used herein is intended to encompass executable and nonexecutable software files, raw data, aggregated data, patches, and other code segments. Further, like numerals refer to like elements throughout the several views, and the articles "a" and "the" includes plural references, unless otherwise specified in the description.

Figure 1:
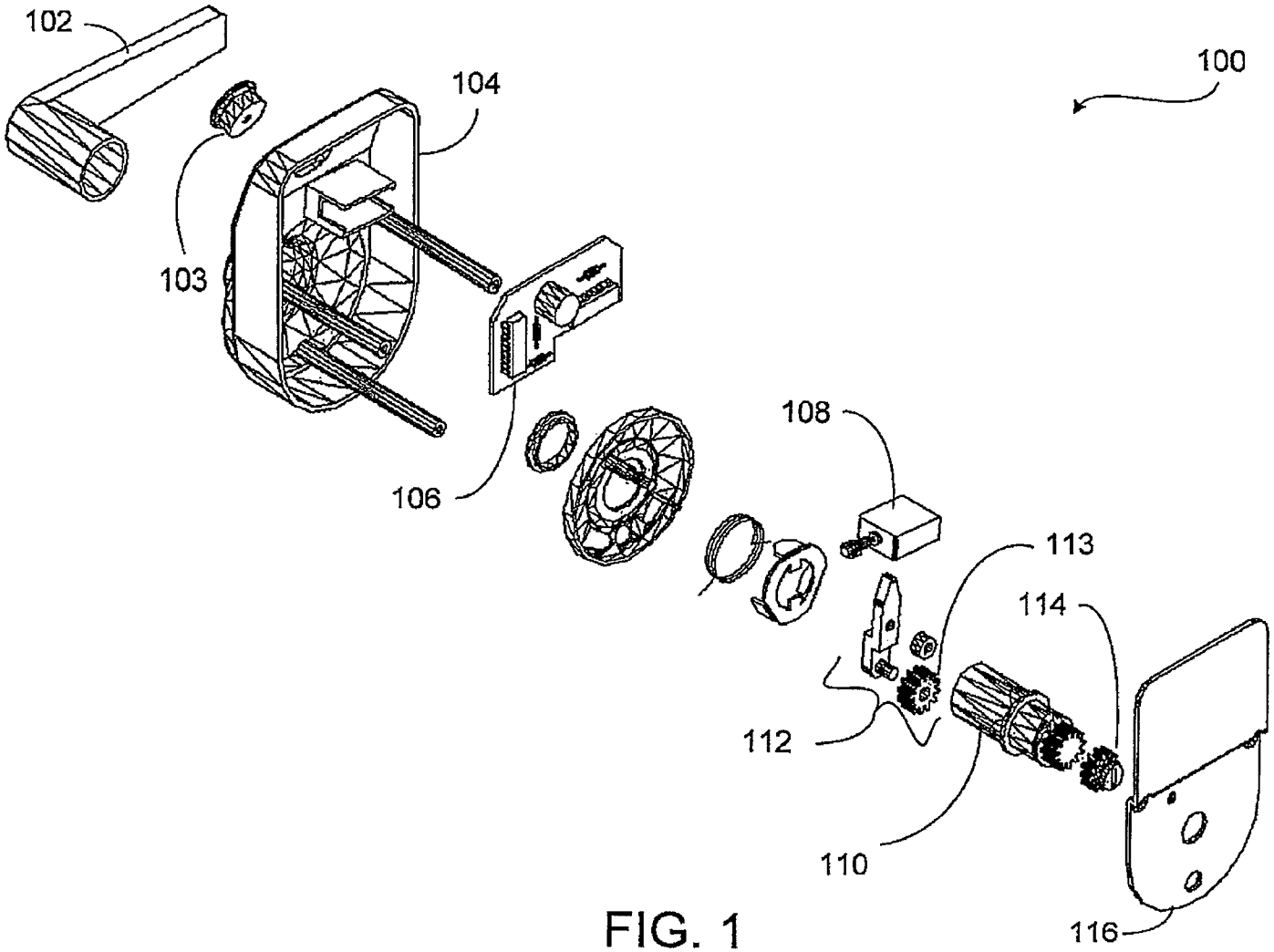
FIG. 1 is an exploded view of an exterior portion of the electronic lock.
Figure 2:
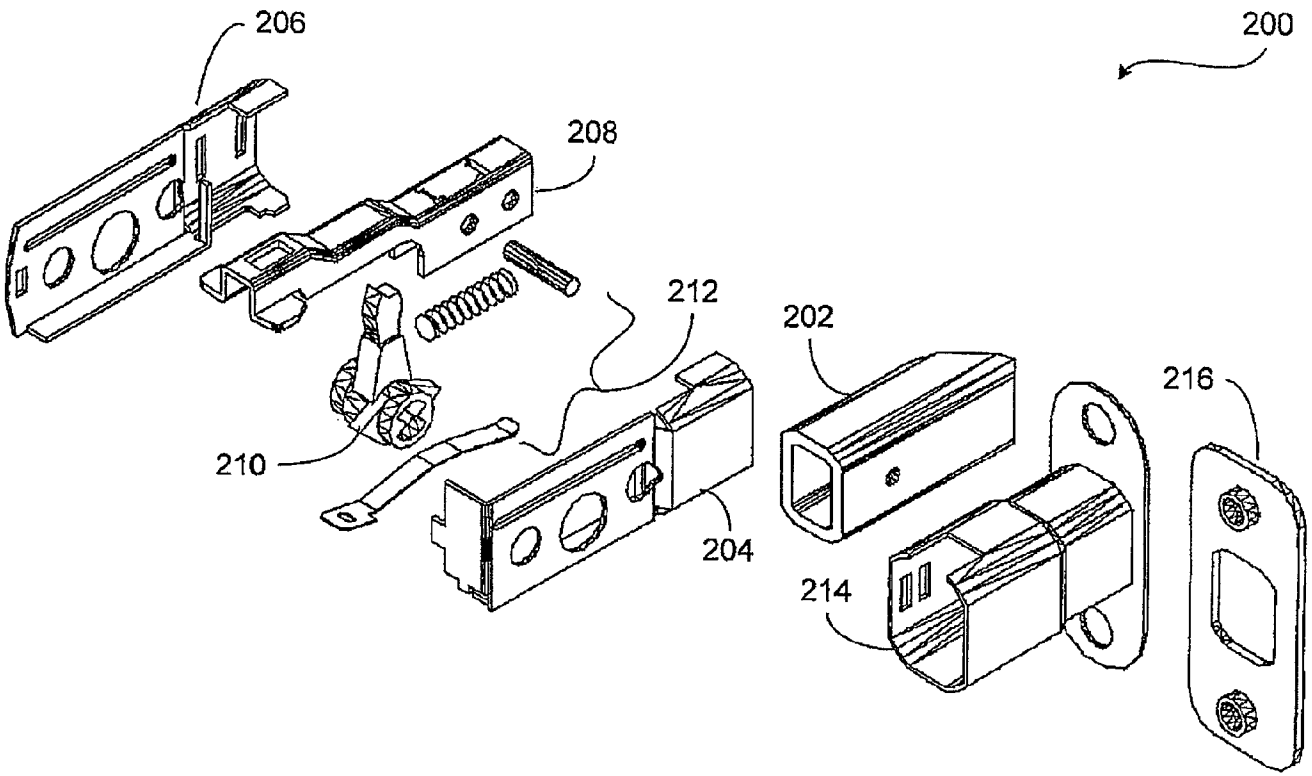
FIG. 2 is an exploded view of a latch assembly for the electronic lock.
Figure 3:
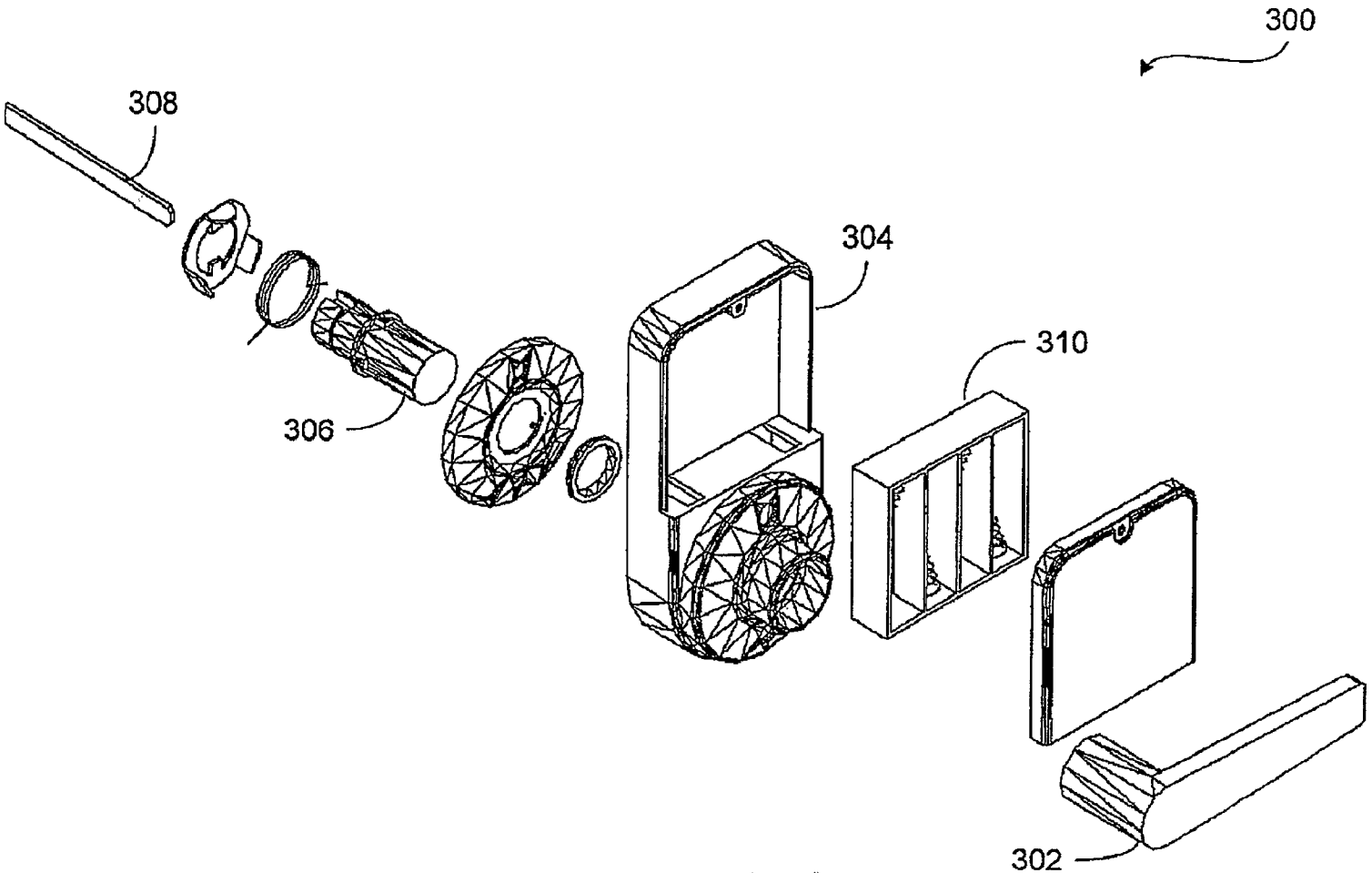
FIG. 3 is an exploded view of an interior portion of the electronic lock.

In overview, the apparatus is a single throw electronically controlled deadbolt lock that can operate as a passage lock as well as a deadbolt lock. The single throw electronic lock can easily retrofit the doors with traditional locks without the need for major modifications to the doors or the door frames. The single throw electronic lock includes an external mechanism mounted on outside of a door, a latch assembled inside of the door, and an internal mechanism mounted on inside of the door. FIGS. 1-3 will describe the electronic lock according to the invention; however, the details of elements a passage lock and a deadbolt lock are well known to those skilled in the art and will be described briefly herein. FIG. 1 illustrates the external mechanism in an exploded view 100. The single throw electronic lock has an external lever (handle) 102 mounted on an external housing 104. The external lever 102 is normally engaged to the outside lever post 110 through a flying gear 113, but the external lever 102 is disengaged from the tailpiece gear 114 (shown in FIG. 3) when the lock is in the deadbolt lock position. The lock is also equipped with an activation access device 103, which can be touch coupling reader (e.g. iButton reader), a magnetic card reader, and a RFID card reader, a bar code reader, a biometric input, or other suitable mechanisms. The activation access device 103 may be equipped with a light emitting diode (LED) that gives a visual indication of different states of the lock, for example, if activation by an activation device has been successful or rejected. The activation access device 103 is mounted on the external housing 104 and connected to a control circuit 106 (connections not shown). The control circuit 106 is connected to and controls an electrical motor 108, which engages through a series of gears a tail piece gear 114. The external mechanism is enclosed by an external housing backplate 116. A data retrieval connector 616 can also be mounted on the external housing. The data retrieval connector allows a user to retrieve an access log from the control circuit 106. The data retrieval connector may be the same as the activation access device 103 when the activation access device 103 is a bi-directional device. The data retrieval connector may also be an independent access port such as a USB port, a serial port, or other type of data ports.

FIG. 2 illustrates an exploded view 200 of a latch. The latch has a single throw 202 enclosed inside the latch housing formed by two parts, 204 and 206. The single throw 202 can act as a passage lock and as well as a deadbolt lock. The throw 202 can move longitudinally along the latch housing and its position is controlled by a slider 208 moving inside the latch housing. The throw 202 has an end surface that is not perpendicular to the longitudinal direction but slanted in relation to the longitudinal direction. Depending on the position of the slider 208, the throw 202 may be resting at the passage lock position or the deadbolt lock position. The movement of the slider 208 is controlled by a pivot 210 and a combination of mechanisms 212 formed by at least one spring and a pin among others. The entire assembly of throw 202, slider 208, and latch housing 204, 206 are fitted in an outer latch housing 214 and mounted on a door. On the door frame, a hole is made at a position corresponding to the throw 202's position and a door face plate (not shown) is placed on the door frame.

FIG. 3 is an exploded view 300 of an internal mechanism. The internal mechanism includes a door lever (handle) 302 mounted on an internal housing 304. The door lever 302 is coupled to an indoor handle post 306, which engages a tail piece 308. The tail piece 308 goes through an opening on the door and the pivot 210 in the latch and engages the tail piece gear 114 in the external mechanism. Moving the internal door lever 302 from a horizontal position, when the throw 202 is in the passage lock position, downwardly will retract the throw 202 into the door and thus opens the door. Moving the internal door lever 302 upwardly from the horizontal position to a vertical position will move the throw 202 into a deadbolt lock position. After placing the throw 202 in the deadbolt lock position, the internal door lever 302 can return to the horizontal position without moving the throw 202 back to the passage position. When the throw 202 is in the deadbolt position, moving the internal door lever 302 downwardly will first move the throw 202 from the deadbolt position into the passage lock position and continuing moving the internal door lever 302 downwardly will retract the throw 202 inside the door and thus opening the door. Releasing the internal door lever 302 afterward will release the throw 202 back to its passage lock position and thus allowing the lock to function as a passage lock. It is also shown in FIG. 3 a power unit 310 that is mounted on the internal housing 304. The power unit 310 can be a compartment for holding multiple batteries and it can also be a rechargeable battery.

The internal mechanism may also include a visual lock indicator 618 mounted on the internal housing 304. The visual lock indicator is connected to the control circuit 106 and will indicate whether the throw 202 is in the deadbolt position. The visual indicator may be a light emitting diode (LED) or other light emitting devices, and the LED may blink when the lock is functioning as a passage lock and remain lighted when the lock is functioning as a deadbolt lock. The visual indicator helps a user to identify the status of the lock visually at distance. Alternatively, the internal door lever 302 may remain in a vertical position when the throw 202 is in the deadbolt position, thus the status of the lock may also be visually identified by the position of the internal door lever 302.

Figure 4:
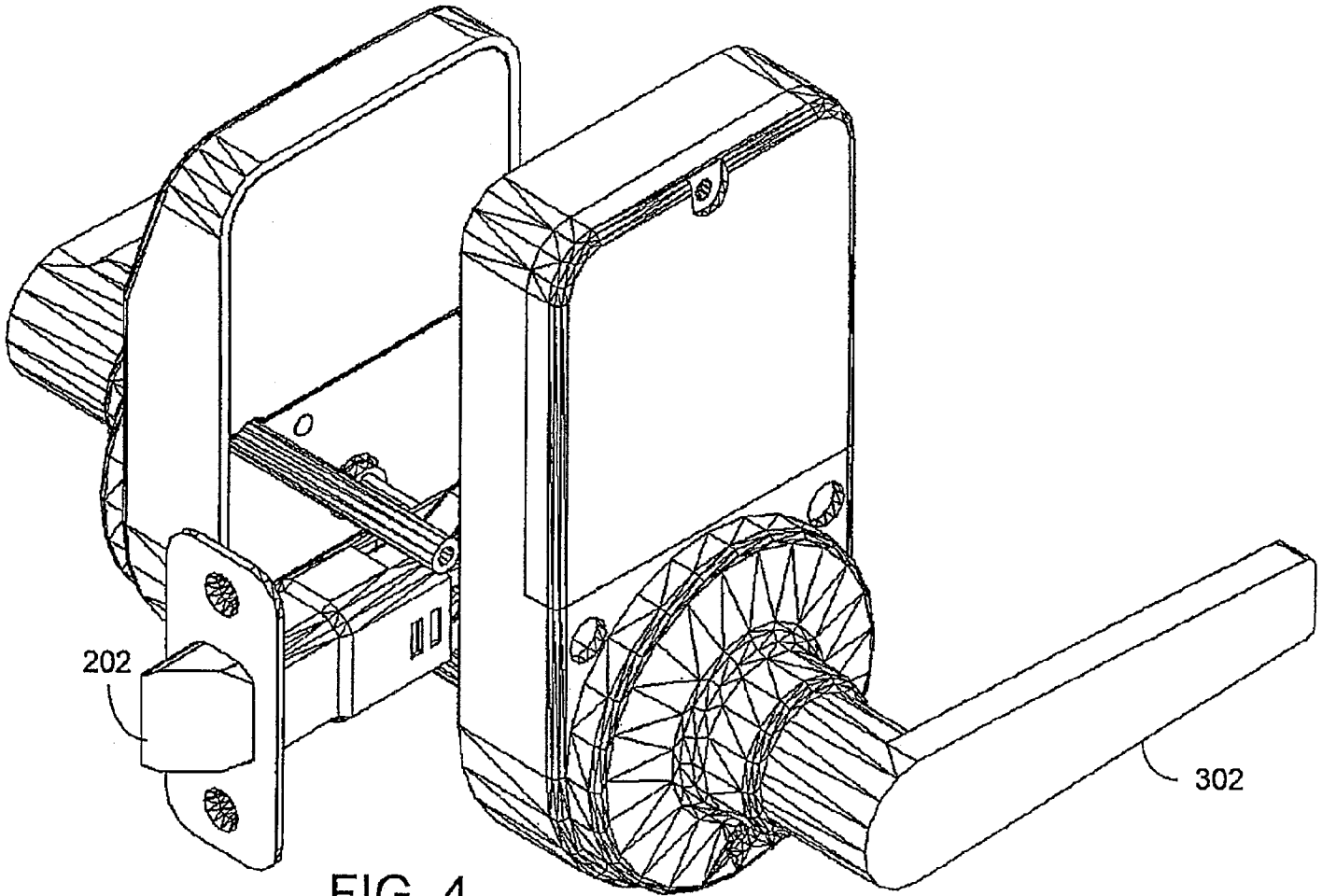
FIG. 4 illustrates the throw in a passage lock position.
Figure 5:
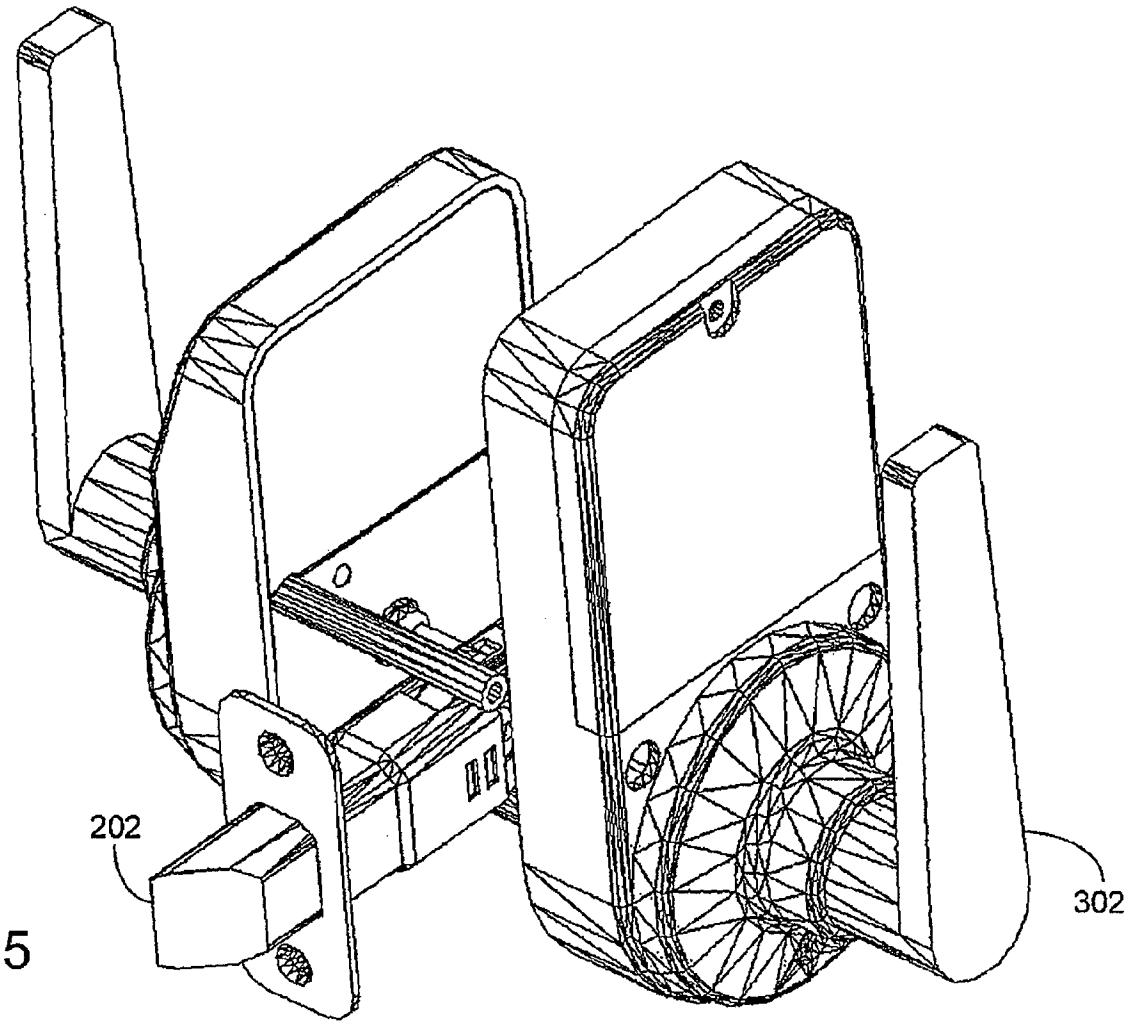
FIG. 5 illustrates the throw in a deadbolt lock position.

FIG. 4 is an illustration of the lock with the throw 202 in the passage lock position. At this position, the lock (throw) can be operated by moving either the internal door lever 302 or the external door lever 102. FIG. 5 is an illustration of the lock with the throw 202 in the deadbolt lock position. The throw 202 is moved into the deadbolt lock position by moving the internal door lever 302 upwardly as shown in FIG. 5. The throw 202 can also be moved into the deadbolt lock position by moving the external door lever 102. However, if the throw 202 is moved into the deadbolt lock position by the external door lever102, the visual lock indicator on the internal housing 304 will flash, indicating that the door is not locked even the throw 202 is in the deadbolt lock position. The external door lever 102 is not disengaged even if the throw 202 is in the deadbolt lock position, and a person can still open the door from outside by moving downwardly the external door lever 102. From outside, the door can be locked and the throw 202 can be moved from the passage lock position into the deadbolt lock position. By using an access device such as an iButton, a magnetic card, etc., the external door lever can be disengaged so that the door cannot be opened from the outside.

Figure 6:
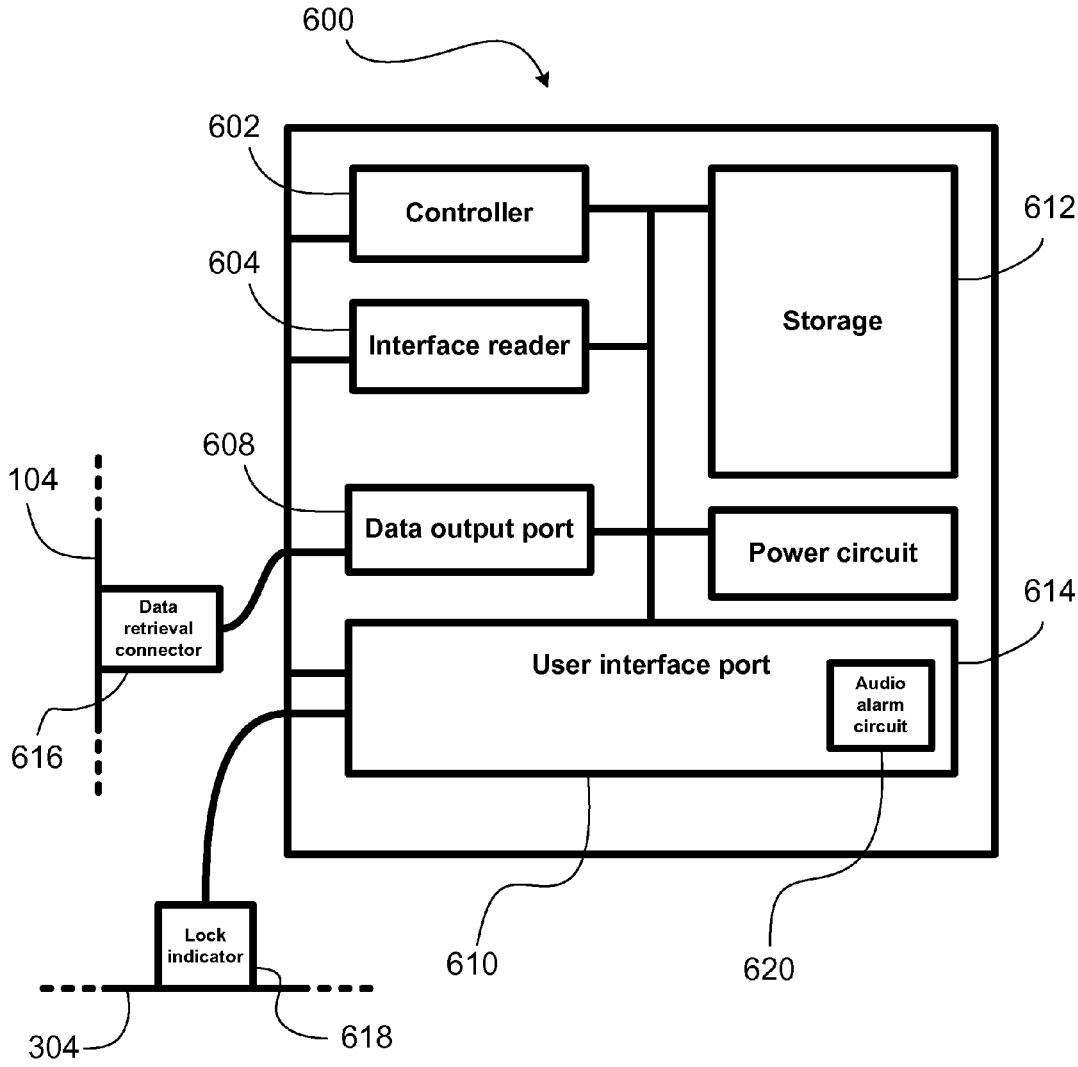
FIG. 6 is an exemplary block diagram for a control circuit.

FIG. 6 is a block diagram 600 of the control circuit 106. The control circuit 106 includes a controller 602, an interface reader 604, a data output port 608, a user interface port 610, a storage unit 612, and a power unit 614. The controller 602 controls operations of the control circuit 106. The interface reader 604 communicates with the activation access device 103. The information from the activation access device 103 is received by the interface reader 604. The data output port 608 is connected to the data retrieval connector 616 that is mounted on the external housing 104 and allows an external data retriever to retrieve an access log stored in the storage unit 612. In an alternative embodiment, the interface reader 604 and the data output port 608 may be combined into a single unit with dual functions. The user interface port 610 is connected to the visual lock indicator 618 mounted on the internal housing 304. The user interface port 610 may also include an audio alarm circuit 620 that provides audio alarm every time the throw 202 moves from the deadbolt lock position to the passage lock position. This audible alarm tells the user that the lock has been successfully unlocked and also gives a warning to a user who is inside a room that the door is being unlocked. The power circuit 614 is connected to the power unit 310 on the internal housing 304. The power circuit 614 receives electricity from the power unit 310 and powers the control circuit 106. In an alternative embodiment, the power circuit 614 is also connected to an external power input connector mounted on the external housing (not shown) that allows a user to supply current from an outside source in the event of the power unit 310 failure. The storage unit 612 is an internal memory that stores a control program that controls the control circuit 106. The storage unit 612 also stores a log that records all access attempts. The control circuit 106 may also include a timing circuit (not shown). The timing circuit provides timing information that may be logged along with any access attempt. The timing circuit also provides a timer that can be used with all accesses. For example, when a user uses an access device to activate the activation access device 103, the control circuit 106 will engage the external door lever 102 to the outside lever post 110 and starts the timer. If the timer expires before the external door lever 102 is activated to move the throw 202 from the deadbolt lock position to the passage lock position, the control circuit 106 will disengage the external door lever 102 from the outside lever post 110 and the lock will remain in the deadbolt lock position.

Figure 7:
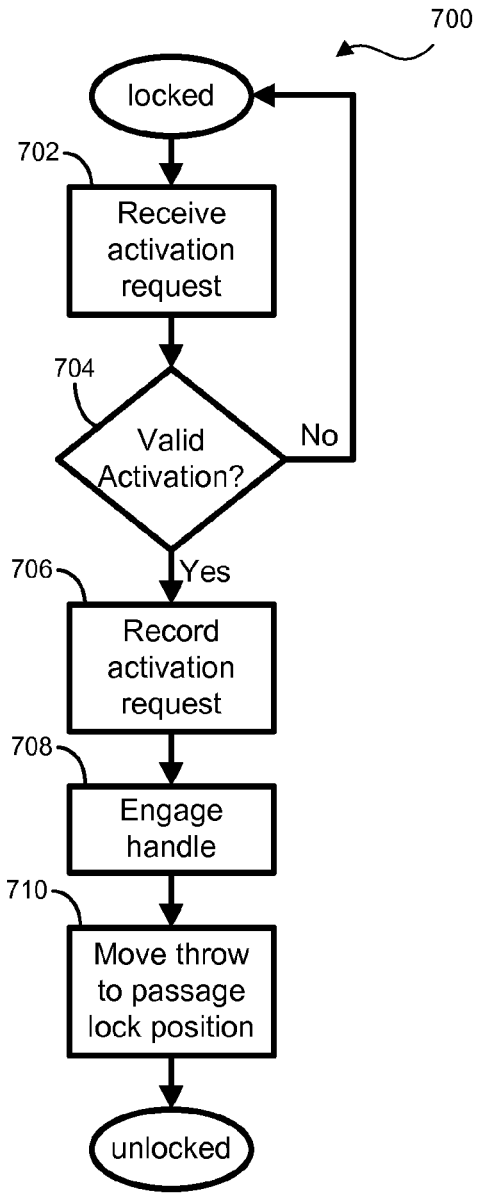
FIG. 7 is a flow chart for an unlocking process.

FIG. 7 illustrates a flow chart 700 for an unlocking process. When the lock is in the locked state (the throw in the deadbolt lock position), a user can activate the activation access device 103 with an activation device, and the activation request is then received by the control circuit 106, step 702. The control circuit 106 validates the activation request, step 704, by comparing the information from the activation request with information stored in the storage unit 612. If the activation request is not from a valid activation device, the lock will remained locked. If the activation request is from a valid activation device, the control circuit 106 will record the activation request along with timing information on a log stored in the storage unit 612, step 706. The control circuit 106 will also engage the outside door lever 102 to the tailpiece gear 114, step 708, and movement of the outside door lever 102 will move the throw 202 from the deadbolt lock position to the passage lock position, step 710. After the throw 202 enters the passage lock position, the lock will be in the unlocked state.

Figure 8:
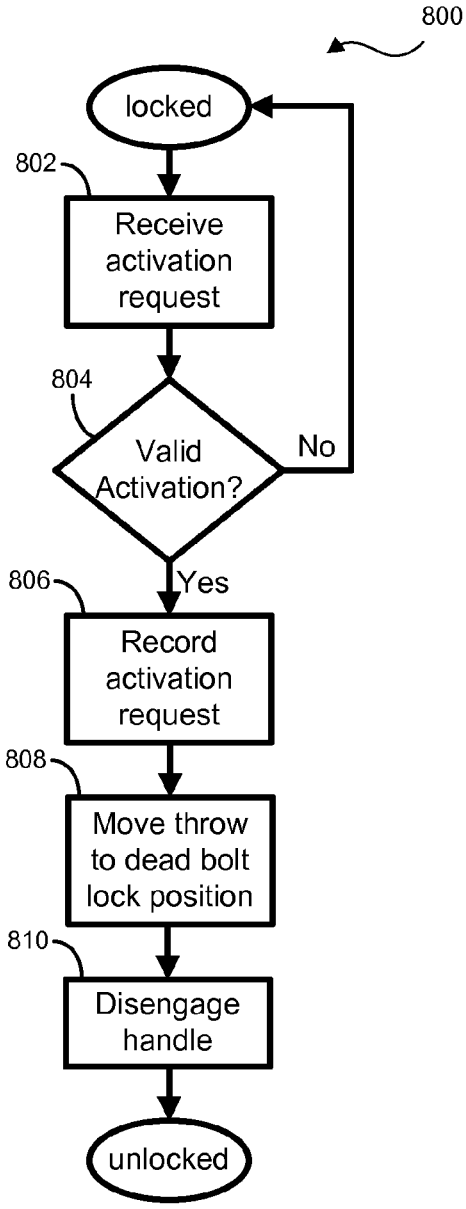
FIG. 8 is a flow chart for a locking process.
Figure 9:
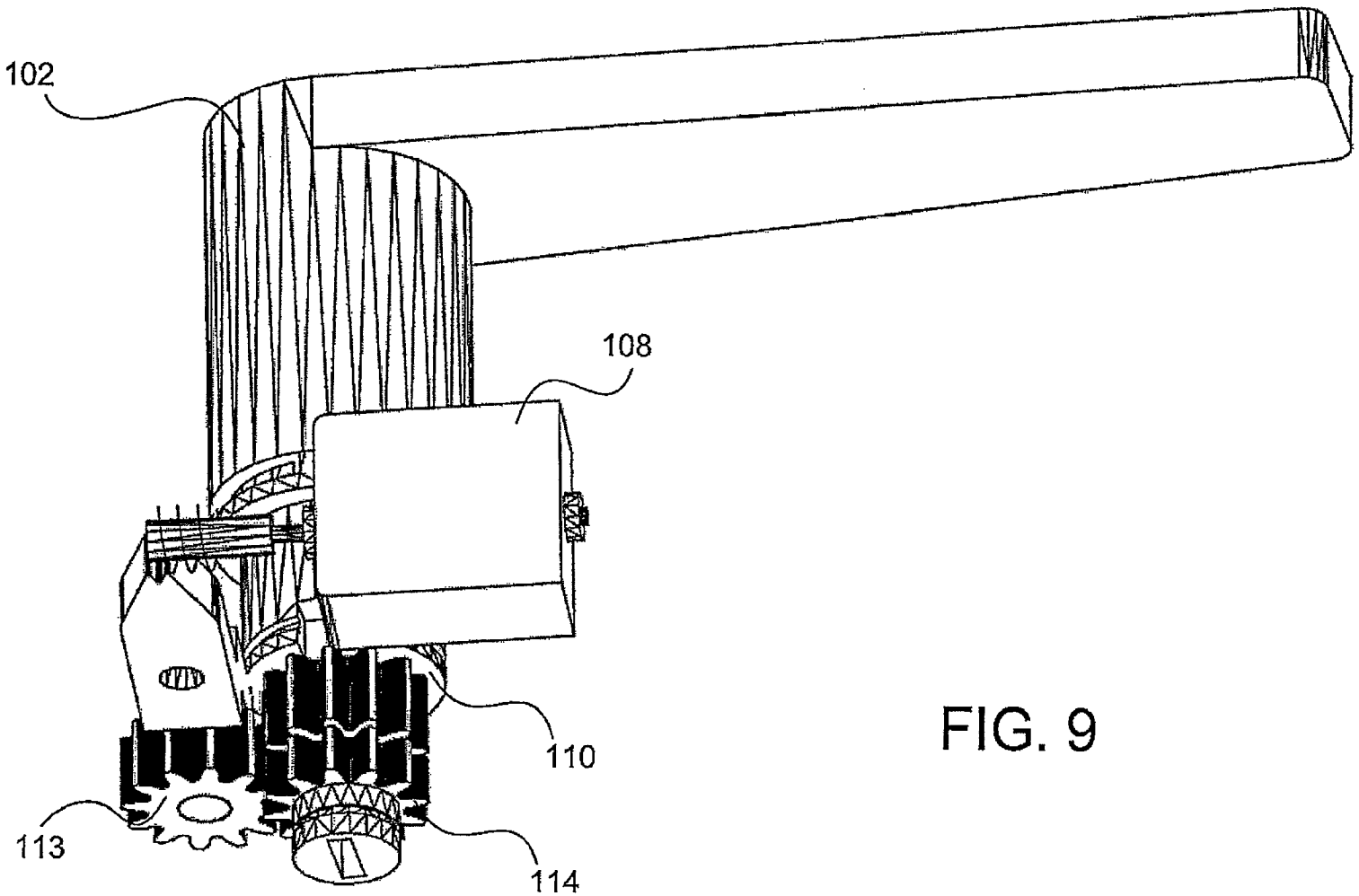
FIGS. 9-11 illustrate additional views of the lock.
Figure 10:
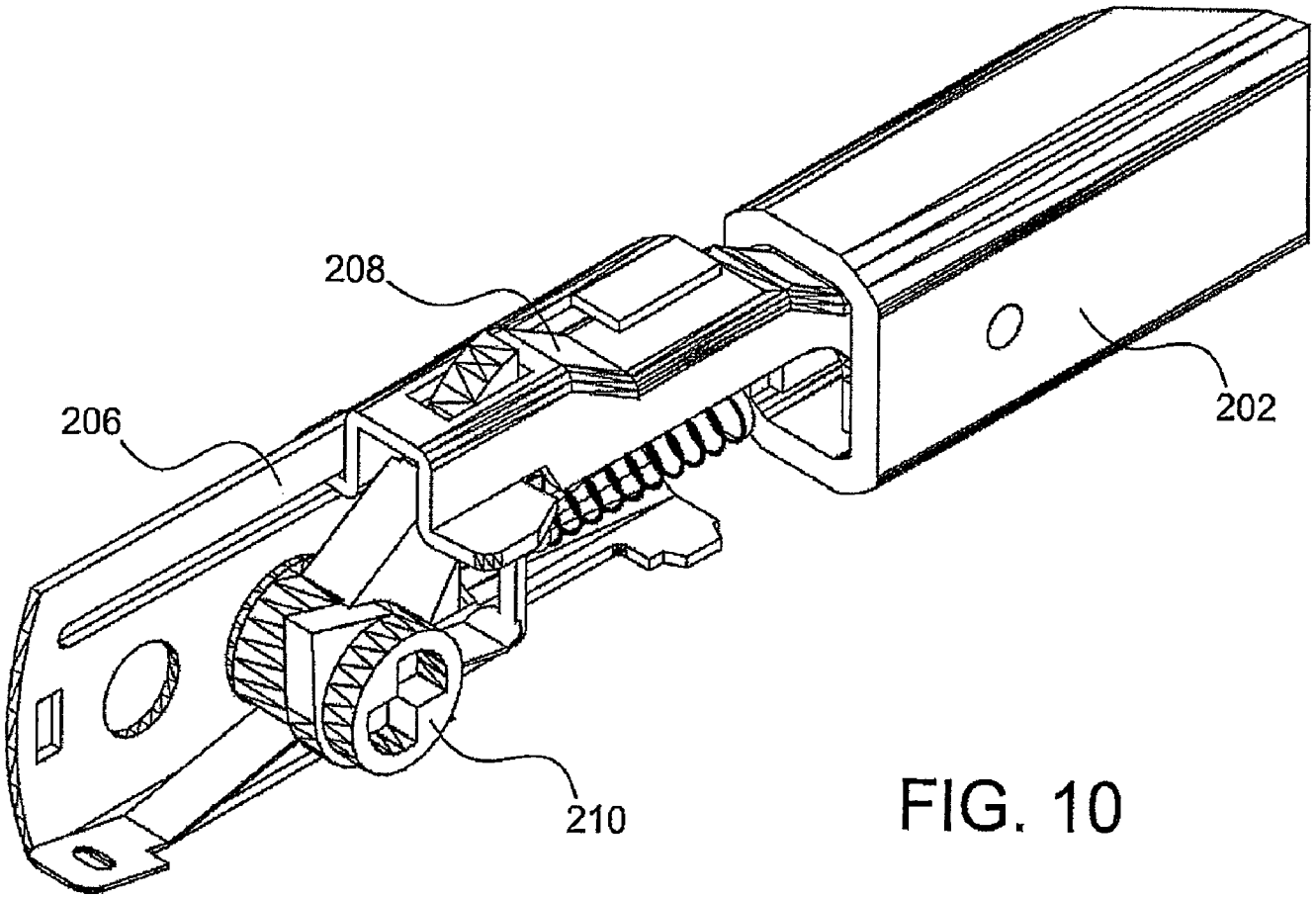
Figure 11:
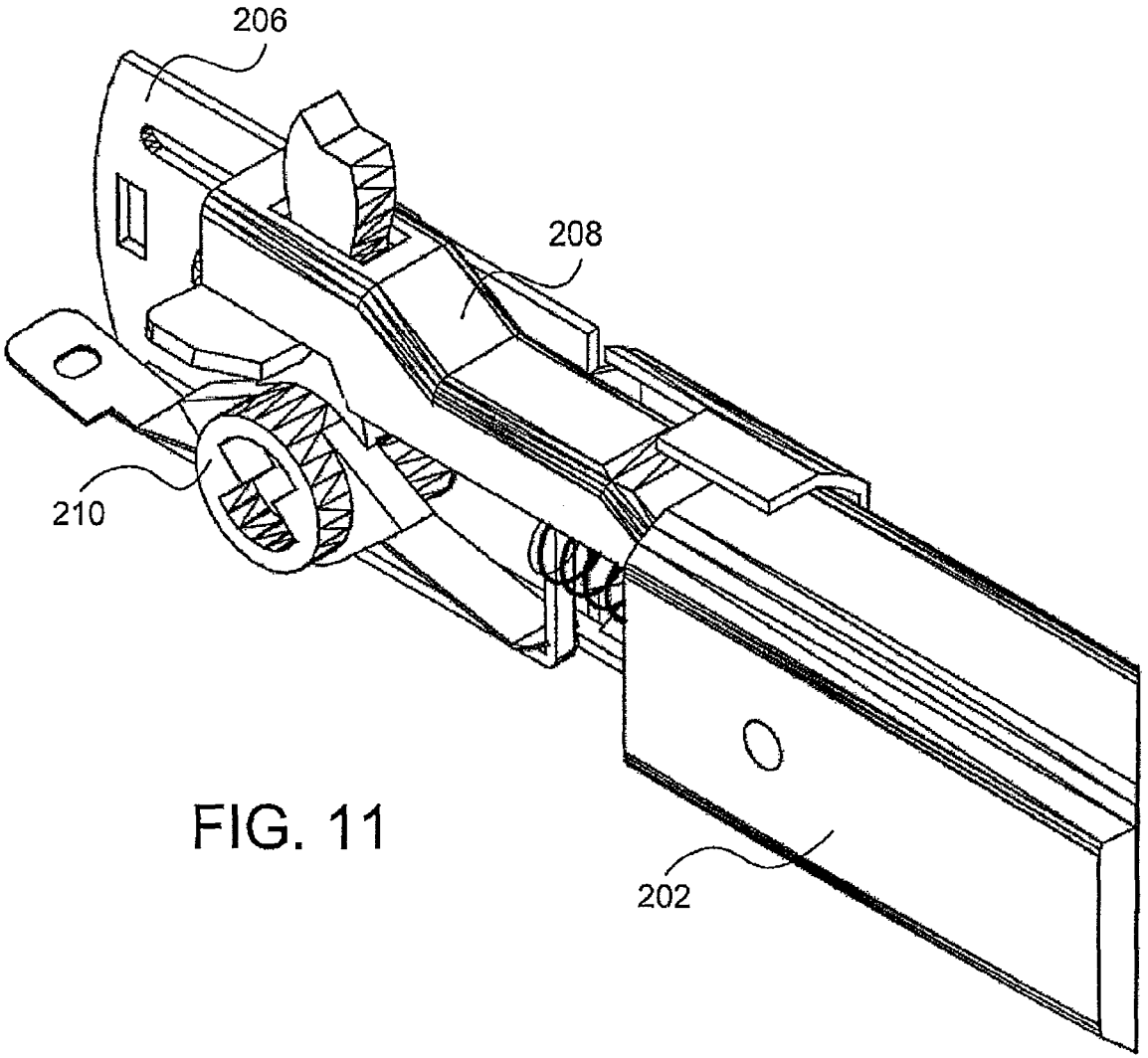

FIG. 8 illustrates a flow chart 800 for a locking process. When the lock is in the unlocked state (the throw in the passage lock position), a user can activate the activation access device 103 with an activation device, and the activation request is then received by the control circuit 106, step 802. The control circuit 106 validates the activation request, step 804, as described above for step 704. If the activation request is not from a valid activation device, the lock will remained unlocked. If the activation request is from a valid activation device, the control circuit 106 will record the activation request along with timing information on a log stored in the storage unit 612, step 806. The user moves the throw 202 from the passage lock position to the deadbolt lock position, step 808, and the outside door lever is disengaged, step 810. After the throw 202 enters the deadbolt lock position, the lock will be in the locked state. Alternatively, the control circuit 106 may set a timer after validating and recording the activation request and before disengaging the external door lever 102 from the outside lever post 110. This would allow a user to use the external door lever 102 to close the door properly.

In operation, a hotel operator can purchase a lock according to the present invention and easily replace it on a door with a traditional single throw bolt without the need to modify either the door or the door frame. After replacing the lock, a guest can open the door with an access device, such as an iButton. By touching the iButton to an iButton reader, the control circuit 106 will receive the activation request from the iButton reader and will validate the activation request. If the guest uses the iButton for room 101 to touch the iButton reader for room 102, the control circuit 106 for the door on room 102 will not validate the access request and the lock will not open. If the control circuit 106 validates the activation request, the throw 202 inside the lock will be moved from the dead lock position to the passage lock position and the external door lever 102 will be engaged to the outside door post 110. The guest then will be able to move the lever 102 and open the door. The control circuit 106 may also emit an audible sound to indicate that the lock is being unlocked.

After entering to the room, the guest can use the internal door lever 302 to close the door. The guest can also move the same door lever 302 from a horizontal position upwardly to a vertical position, thus setting the lock to a deadbolt lock position. After the lock is set to a deadbolt lock position, the internal door lever 302 will return to the horizontal position and the throw 202 will remain in the deadbolt lock position. After the lock is locked, the external door lever 102 is disengaged and a third party can no longer open the door by moving the external door lever 102. When the external door lever 102 is disengaged, the external door lever 102 can move freely upward and downward without affecting the throw 202. Alternatively, the external door lever 102 can also remain at a fixed position when it is disengaged. The guest can easily verify that the lock is in the deadbolt lock position through the visual indicator (LED). Alternatively, the guest can also learn the status of the lock through the position of the internal door lever. The guest's access is recorded in a log inside the control circuit 106.

When the guest is ready to leave the room, the guest can unlock the lock by moving the internal door lever from a horizontal position downwardly to a vertical position, thus setting the lock to the passage lock position. By further moving the internal door lever 302 downwardly, the guest will open the door. The guest can leave the room and close the door; the guest can also return to the room by using the external door lever 102 to open the door. When the guest is ready to leave the room for an extended time period, the guest can use the iButton to lock the door. The guest exits the room, closed the door and touches the iButton to the reader, and then engages the deadbolt by moving the outside door lever upward to the vertical position within a grace time period. After the grace time period, the control circuit 106 disengages the outside door lever from the tailpiece gear 114. At this time the door cannot be opened from the outside until the iButton is touched again.

Periodically the hotel operator can retrieve and review the access log stored inside the control circuit 106. The hotel operator uses his special iButton equipped with a special retrieval feature and sends a retrieval command to the control circuit 106. The retrieval command is received and interpreted by the control circuit 106 and the access log file is retrieved and sent to the special iButton. The hotel operator can then use the special iButton to transfer the access log information to his computer. Alternatively, the hotel operator may connect a portable memory to the data retrieval connector and then activate the log transfer by touching the iButton reader with his special iButton.

In the context of FIGS. 7 and 8, the method may be implemented, for example, by an operating system on the control circuit or a state machine implemented on the control circuit. The instructions can reside in various types of data storage primary, secondary, or tertiary media. The media may comprise, for example, RAM (not shown) accessible by, or residing within, the components of the control circuit. Whether contained in RAM or other secondary storage media, the instructions may be stored on a variety of machine-readable data storage media, such as read-only memory (e.g., ROM, EPROM, or EEPROM).

While the invention has been particularly shown and described with reference to a preferred embodiment thereof, it will be understood by those skilled in the art that various changes in form and detail may be made without departing from the spirit and scope of the present invention as set forth in the following claims. Furthermore, although elements of the invention may be described or claimed in the singular, the plural is contemplated unless limitation to the singular is explicitly stated.

What is claimed:

1. A method for using a single bolt of an electronic lock as a deadbolt lock and passage lock, the electronic lock being mounted on a door and having an internal lever, an external lever, a latch, and a throw, comprising the steps of:

receiving an activation request from an activation access device of the electronic lock;

validating the activation request;

engaging the external lever to the latch;

moving the throw in the latch from a deadbolt lock position into a passage lock position when the external lever is moved while engaged to the latch;

moving the throw from the passage lock position to the deadbolt lock position when the internal lever is moved from a horizontal position to an upward vertical position; and retracting the throw from the passage lock position into the door when the internal lever is moved from a horizontal position to a downward vertical position.

2. The method of claim 1, further comprising the step of recording the activation request into a log.

3. The method of claim 2, further comprising the step of transferring information in the log to the activation access device.

4. The method of claim 1, further comprising the step of emitting an audible alarm when the throw being moved to the passage lock position.

5. The method of claim 1, further comprising the step of receiving power from an external power unit.

6. The method of claim 1, further comprising the step of activating a visual indicator to indicate the latch being in the passage lock position.

7. The method of claim 1, further comprising the steps of:

receiving a second activation request from an activation access device;

starting a timer;

placing the throw to the deadbolt lock position when the external lever being moved from a horizontal position to an upward vertical position; and disengaging the external lever from the latch when the timer expires.

8. A method for using a single bolt of an electronic lock as a deadbolt lock and as a passage lock, the electronic lock being mounted on a door and having an internal lever, an external lever, a latch, and a throw, comprising the steps of:

providing on a door an electronic locking mechanism having an activation access device, with an internal lever and external lever, and the electronic locking mechanism having a single bolt that at least has a passage position and a locking position; and electronically disengaging the bolt from the external lever while in the locking position by activating the activation access device;

wherein the bolt is configured to be moved from the passage position to the locking position when the internal lever is rotated from a horizontal position to an upward vertical position,and wherein the bolt is configured to be retracted from the passage position into the door when the internal lever is rotated from a horizontal position to a downward vertical position.

* * * * *